US009815171B2

(12) United States Patent
Yamaki et al.

(10) Patent No.: US 9,815,171 B2
(45) Date of Patent: Nov. 14, 2017

(54) SUBSTRATE HOLDER, POLISHING APPARATUS, POLISHING METHOD, AND RETAINING RING

(71) Applicant: EBARA CORPORATION, Tokyo (JP)

(72) Inventors: Satoru Yamaki, Tokyo (JP); Hozumi Yasuda, Tokyo (JP); Keisuke Namiki, Tokyo (JP); Osamu Nabeya, Tokyo (JP); Makoto Fukushima, Tokyo (JP); Shingo Togashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 63 days.

(21) Appl. No.: 14/537,809

(22) Filed: Nov. 10, 2014

(65) Prior Publication Data

US 2015/0133038 A1 May 14, 2015

(30) Foreign Application Priority Data

Nov. 13, 2013 (JP) ..... 2013-235210
Apr. 30, 2014 (JP) ..... 2014-093840

(51) Int. Cl.
*B24B 37/32* (2012.01)
*B24B 37/10* (2012.01)
*B24B 37/04* (2012.01)

(52) U.S. Cl.
CPC ..... *B24B 37/32* (2013.01); *B24B 37/04* (2013.01); *B24B 37/107* (2013.01)

(58) Field of Classification Search
CPC ..... B24B 37/04; B24B 37/30; B24B 37/32; B24B 37/107
See application file for complete search history.

(56) References Cited

U.S. PATENT DOCUMENTS 5,681,215 A * 10/1997 Sherwood ..... B24B 37/32 451/288
5,795,215 A 8/1998 Guthrie et al.
6,027,398 A * 2/2000 Numoto ..... B24B 37/30 451/285
6,077,385 A 6/2000 Kimura et al.
6,110,025 A * 8/2000 Williams ..... B24B 37/32 451/286
6,113,468 A * 9/2000 Natalicio ..... B24B 37/30 451/41
6,116,992 A * 9/2000 Prince ..... B24B 37/30 156/345.14

(Continued)

FOREIGN PATENT DOCUMENTS

CN 101045286 A 10/2007
JP 10-286769 10/1998

(Continued)

*Primary Examiner* — Timothy V Eley
(74) *Attorney, Agent, or Firm* — Baker & Hostetler LLP

(57) ABSTRACT

A substrate holder capable of preventing an increase in a polishing rate of an edge portion of a substrate, even when polishing a plurality of substrates successively, is disclosed. The substrate holder includes: a top ring body configured to hold the substrate; and a retaining ring disposed so as to surround the substrate held by the top ring body. The retaining ring includes a pad pressing structure in an annular shape which is to be brought into contact with the polishing pad, and the pad pressing structure has a width in a range of 3 mm to 7.5 mm.

27 Claims, 17 Drawing Sheets

(56) References Cited

U.S. PATENT DOCUMENTS 6,390,904 B1 * 5/2002 Gleason ..... B24B 37/32 156/345.12
6,409,583 B1 * 6/2002 Numoto ..... B24B 37/30 451/259
6,419,567 B1 * 7/2002 Glashauser ..... B24B 37/32 451/259
6,428,403 B1 * 8/2002 Kimura ..... B24B 37/30 451/288
6,648,739 B2 * 11/2003 Izumi ..... B24B 37/32 451/286
6,913,516 B1 7/2005 Wang et al.
7,094,133 B2 * 8/2006 Masunaga ..... B24B 37/32 451/286
7,121,927 B2 * 10/2006 Phang ..... B24B 37/32 451/285
7,459,057 B2 * 12/2008 Zuniga ..... B24B 37/28 156/345.14
8,033,895 B2 * 10/2011 Prabhu ..... B24B 37/32 451/286
2007/0141960 A1 * 6/2007 Chandrasekaran ..... B24B 37/32 451/41
2007/0212988 A1 * 9/2007 Nabeya ..... B24B 49/16 451/287
2010/0120335 A1 * 5/2010 Fang ..... B24B 37/32 451/41
2010/0273405 A1 10/2010 Fukushima et al.
2012/0034848 A1 * 2/2012 Chen ..... B24B 37/32 451/28
2013/0102152 A1 * 4/2013 Chao ..... B24B 37/32 438/692

FOREIGN PATENT DOCUMENTS

JP 2013-202755 A 10/2013
WO WO 2005/049274 A2 6/2005

* cited by examiner

PRIOR ART

SUBSTRATE HOLDER, POLISHING APPARATUS, POLISHING METHOD, AND RETAINING RING

CROSS REFERENCE TO RELATED APPLICATIONS

This document claims priorities to Japanese Patent Application Number 2013-235210 filed Nov. 13, 2013 and Japanese Patent Application Number 2014-93840 filed Apr. 30, 2014, the entire contents of which are hereby incorporated by reference.

BACKGROUND

In a fabrication process of a semiconductor device, a polishing app widely used for polishing a surface of a wafer. The polishing apparatus of this type includes a polishing table for supporting a polishing pad having a polishing surface, a substrate holder, which is called a top ring or a polishing head, for holding the wafer, and a polishing liquid supply nozzle for supplying a polishing liquid onto the polishing surface.

The polishing apparatus polishes the wafer as follows. The polishing table is rotated together with the polishing pad, while the polishing liquid is supplied from the polishing liquid supply nozzle onto the polishing surface. The wafer is held by the substrate holder, and the wafer is rotated about its axis. In this state, the substrate holder presses the surface of the wafer against the polishing surface of the polishing pad so that the surface of the wafer is placed in sliding contact with the polishing surface in the presence of the polishing liquid. The surface of the wafer is planarized by a mechanical action of abrasive grains contained in the polishing liquid and a chemical action of the polishing liquid. Such polishing apparatus is called a CMP (chemical mechanical polishing) apparatus.

During polishing of the wafer, a frictional force acts on the wafer, because the surface of the wafer is in sliding contact with the polishing pad. Therefore, in order to prevent the wafer from disengaging from the substrate holder during polishing of the wafer, the substrate holder includes a retaining ring. This retaining ring is disposed so as to surround the wafer, and is configured to press the polishing pad outside the wafer.

A polishing rate (which is also referred to as a removal rate) of the wafer can vary depending on polishing conditions, such as a load of the wafer on the polishing pad, a load of the retaining ring, rotating speeds of the polishing table and the wafer, and type of polishing liquid. In a case of polishing a plurality of wafers successively, the polishing conditions are typically kept constant in order to obtain the same polishing results. However, as the wafers are polished, an edge profile of each wafer may vary gradually despite the same polishing conditions. Specifically, the polishing rate of an edge portion of the wafer increases in accordance with an increase in the number of polished wafers.

A possible cause of such an increase in the polishing rate is a deformation of the retaining ring. FIG. 19 is a schematic view showing the retaining ring when polishing of a wafer is performed. As shown in FIG. 19, during polishing of a wafer W, a retaining ring 200 is pressed against a polishing surface 201*a* of a rotating polishing pad 201. As a result, the retaining ring 200 wears. In particular, an inner circumferential surface and an outer circumferential surface of the retaining ring 200 wear, thus forming a rounded shape. If the inner circumferential surface of the retaining ring 200 wears as shown in FIG. 19, a force of the retaining ring 200 that presses a pad region near the edge portion of the wafer W is reduced. As a result, the polishing rate of the edge portion increases.

SUMMARY OF THE INVENTION

According to an embodiment, there is provided a substrate holder capable of preventing an increase in a polishing rate of an edge portion of a substrate, even when polishing a plurality of substrates (e.g., wafers) successively. Further, according to another embodiment, there is provided a polishing apparatus and a polishing method using such a substrate holder. Furthermore, according to another embodiment, there is provided a retaining ring for use in the substrate holder.

Embodiments, which will be described below, relate to a substrate holder for holding a substrate, such as a wafer, and more particularly to a substrate holder for use in polishing a surface of a substrate by pressing the substrate against a polishing tool, such as a polishing pad. Further, embodiments relate to a polishing apparatus and a polishing method using such a substrate holder. Furthermore, embodiments relate to a retaining ring for use in the substrate holder.

In an embodiment, there is provided a substrate holder for pressing a substrate a polishing pad, comprising: a top ring body configured to hold the substrate; and a retaining ring disposed so as to surround the substrate held by the top ring body, the taming ring including a pad pressing structure in an annular shape which is to be brought into contact with the polishing pad, and the pad pressing structure having a width in a range of 3 mm to 7.5 mm.

In an embodiment, there is provided a polishing apparatus comprising: a polishing table for supporting a polishing pad; a substrate holder configured to hold a substrate and to press the substrate against the polishing pad; and a polishing liquid supply nozzle configured to supply a polishing liquid onto the polishing pad, the substrate holder including a top ring body configured to hold the substrate, and a retaining ring disposed so as to surround the substrate held by the top ring body, the retaining ring including a pad pressing structure in an annular shape which is to be brought into contact with the polishing pad, and the pad pressing structure having a width in a range of 3 mm to 7.5 mm.

In an embodiment, there is provided a polishing method comprising: rotating a polishing table and a polishing pad; supplying a polishing liquid onto the polishing pad; and pressing a substrate against the polishing pad while pressing a substrate against the polishing pad while a pad pressing structure is surrounding the substrate and pressing the polishing pad, the pad pressing structure being in an annular shape having a width in a range of 3 mm to 7.5 mm.

In an embodiment, there is provided a retaining ring for use in a substrate holder for pressing a substrate against a polishing pad, comprising: a pad pressing structure in an annular shape which is to be brought into contact with the polishing pad, the pad pressing structure having a width in a range of 3 mm to 7.5 mm.

Since the width of the pad pressing structure is small, the pad pressing structure can have a self-restoring function of its shape. That is when the shape of the pad pressing structure is changed as a result of the wear, an area of the pad contact surface of the pad pressing structure is reduced while the pressure of the pad contact surface is increased. When the pressure of the pad contact surface is increased, the pad contact surface is more likely to wear, and as a result the area of the pad contact surface is increased. While such small changes in the pressure and the area of the pad contact surface occur repeatedly, the shape of the pad pressing structure is kept approximately constant. Therefore, the retaining ring having the narrow pad pressing structure can stabilize the polishing rate at the edge portion of the substrate.

DESCRIPTION OF EMBODIMENTS

Embodiments will be described in detail below with reference to the drawings.

Figure 1:
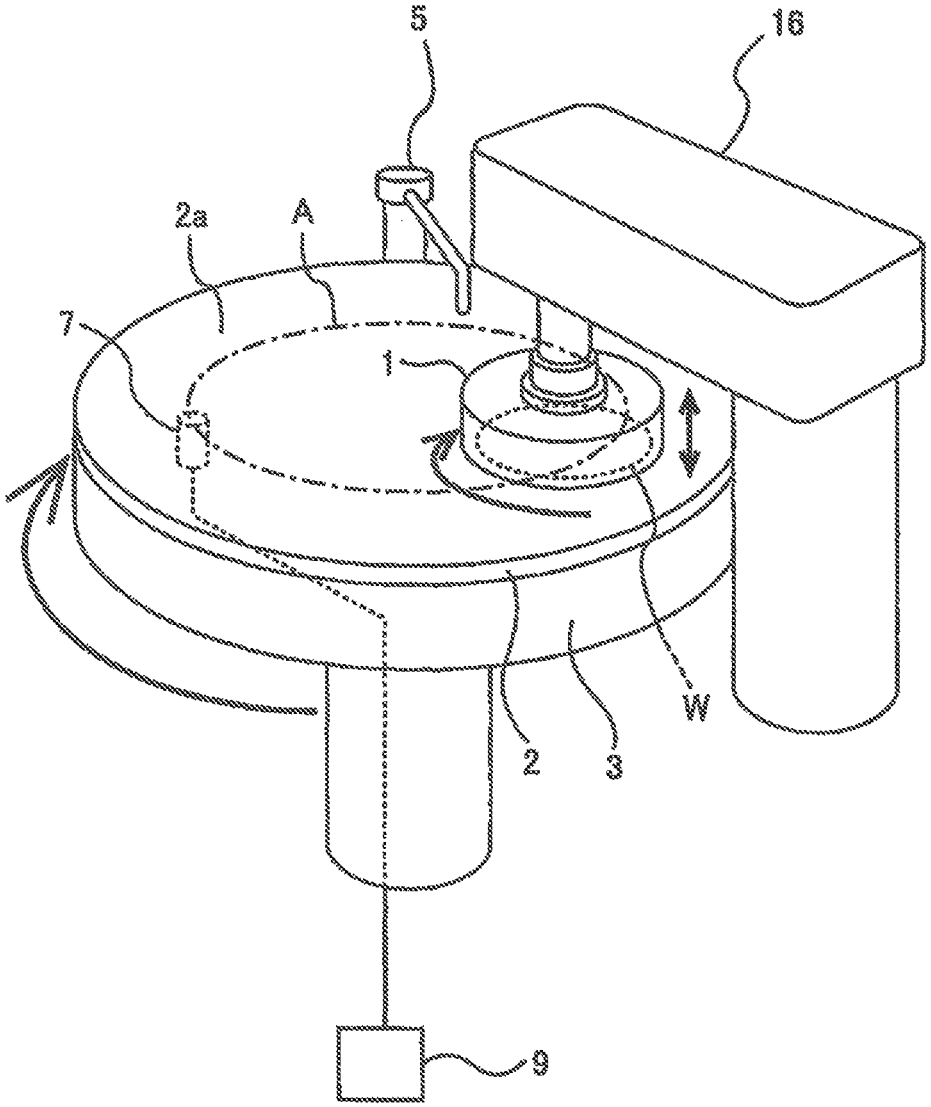
FIG. 1 is a schematic view of a polishing apparatus including a substrate holder according to an embodiment.

FIG. 1 is a schematic view of a polishing apparatus including a substrate holder according to an embodiment. As shown in FIG. 1, the polishing apparatus includes a top ring (or a substrate holder) 1 for holding and rotating a wafer (i.e., a substrate) W, a polishing table 3 for supporting a polishing pad 2 thereon, a polishing liquid supply nozzle 5 for supplying a polishing liquid (e.g., slurry) onto the polishing pad 2, and a film thickness sensor 7 for obtaining a film thickness signal that varies according to a film thickness of the wafer W. The film thickness sensor 7 is disposed in the polishing table 3 and obtains the film thickness signal at multiple regions, including a central region, of the wafer W every time the polishing table 3 makes one revolution. Examples of the film thickness sensor 7 include an optical sensor and an eddy current sensor.

The top ring 1 is configured to hold the wafer W on its lower surface by vacuum suction. The top ring 1 and the polishing table 3 rotate in the same direction as indicated by arrows. In this state, the top ring 1 presses the wafer W against a polishing surface 2*a* of the polishing pad 2. The polishing liquid is supplied from the polishing liquid supply nozzle 5 onto the polishing pad 2, so that the wafer W is polished by sliding contact with the polishing pad 2 in the presence of the polishing liquid. During polishing of the wafer W, the film thickness sensor 7 rotates together with the polishing table 3 and obtains the film thickness signal while sweeping across a surface of the wafer W as shown by a symbol A. This film thickness signal is an index value indicating the film thickness directly or indirectly, and varies in accordance with a decrease in the film thickness of the wafer W. The film thickness sensor 7 is coupled to a polishing controller 9 so that the film thickness signal is transmitted to the polishing controller 9. This polishing controller 9 is configured to terminate polishing of the wafer W when the film thickness of the wafer W, which is indicated by the film thickness signal, has reached a predetermined target value.

Figure 2:
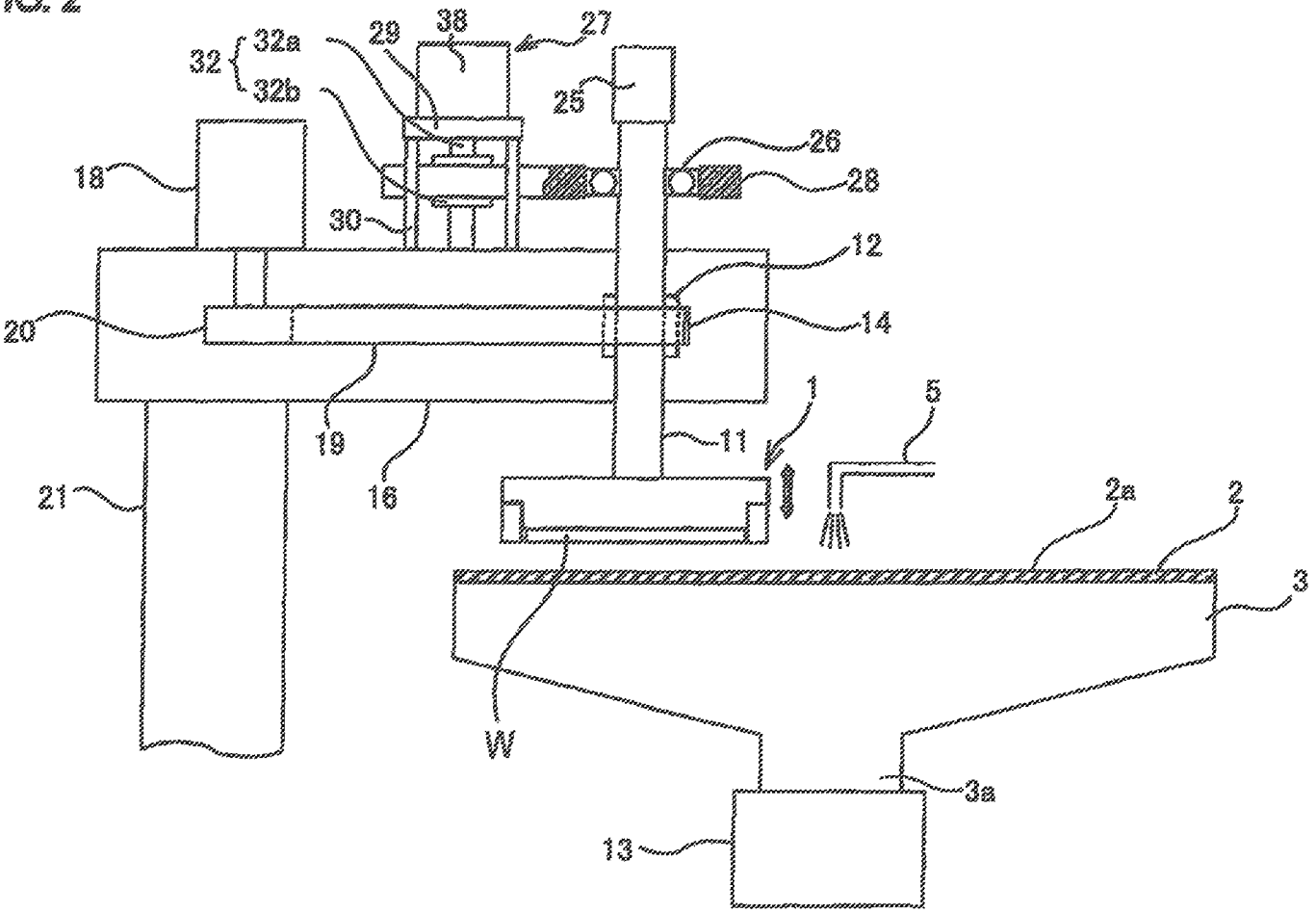
FIG. 2 is a view showing a detailed structure of the polishing apparatus.

FIG. 2 is a view showing a detailed structure of the polishing apparatus. The polishing table 3 is coupled to a motor 13 through a table shaft 3*a* and is rotated about the table shaft 3*a* by the motor 13 which is disposed below the polishing table 3. The polishing pad 2 is attached to an upper surface of the polishing table 3. An upper surface of the polishing pad 2 provides the polishing surface 2*a* for polishing the wafer W. When the polishing table 3 is rotated by the motor 13, the polishing surface 2*a* moves relative to the top ring 1. Therefore, the motor 13 serves as a polishing surface moving mechanism for moving the polishing surface 2*a* horizontally.

The top ring 1 is coupled to a top ring shaft 11, which is movable vertically relative to a top ring head 16 by a vertically moving mechanism 27. A vertical movement and positioning of the top ring 1 in its entirety relative to the top ring head 16 are achieved by the vertical movement of the top ring shaft 11. A rotary joint 25 is mounted to an upper end of the top ring shaft 11.

The vertically moving mechanism 27 for elevating and lowering the top ring shaft 11 and the top ring 1 includes a bridge 28 for rotatably supporting the top ring shaft 11 through a bearing 26, a ball screw 32 mounted to the bridge 28, a support base 29 supported by pillars 30, and a servomotor 38 mounted to the support base 29. The support base 29 for supporting the servomotor 38 is secured to the top ring head 16 through the pillars 30.

The ball screw 32 has a screw shaft 32*a* coupled to the servomotor 38 and a nut 32*b* which is in engagement with the screw shaft 32*a*. The top ring shaft 11 is configured to move vertically together with the bridge 28. Therefore, when the servomotor 38 is set in motion, the bridge 28 moves vertically through the ball screw 32 to cause the top ring shaft 11 and the top ring 1 to move vertically.

The top ring shaft 11 is further coupled to a rotary cylinder 12 through a key (not shown). This rotary cylinder 12 has a timing pulley 14 on its outer circumferential surface. A top ring motor 18 is secured to the top ring head 16, and a timing pulley 20 is mounted to the top ring motor 18. The timing pulley 14 is coupled to the timing pulley 20 through a timing belt 19. With these configurations, rotation of the top ring motor 18 is transmitted to the rotary cylinder 12 and the top ring shaft 11 through the timing pulley 20, the timing belt 19, and the timing pulley 14 to rotate the rotary cylinder 12 and the top ring shaft 11 in unison, thus rotating the top ring 1 about its own axis. The top ring motor 18, the timing pulley 20, the timing belt 19, and the timing pulley 14 constitute a rotating mechanism for rotating the top ring 1 about its own axis. The top ring head 16 is supported by a top ring head shaft 21 which is rotatably supported by a frame (not shown).

The top ring 1 is configured to hold a substrate, such as the wafer W, on its lower surface. The top ring head 16 is configured to be able to pivot on the top ring head shaft 21, so that the top ring 1, holding the wafer W on its lower surface, is moved from a wafer transfer position to a position above the polishing table 3 by the pivotal movement of the top ring head 16. The top ring 1 is then lowered and presses the wafer W against the polishing surface 2*a* of the polishing pad 2, while the top ring 1 and the polishing table 3 are rotated and the polishing liquid is supplied onto the polishing pad 2 from the polishing liquid supply nozzle 5 disposed above the polishing table 3. The wafer W is placed in sliding contact with the polishing surface 2*a* of the polishing pad 2, whereby the surface of the wafer W is polished.

Figure 3:
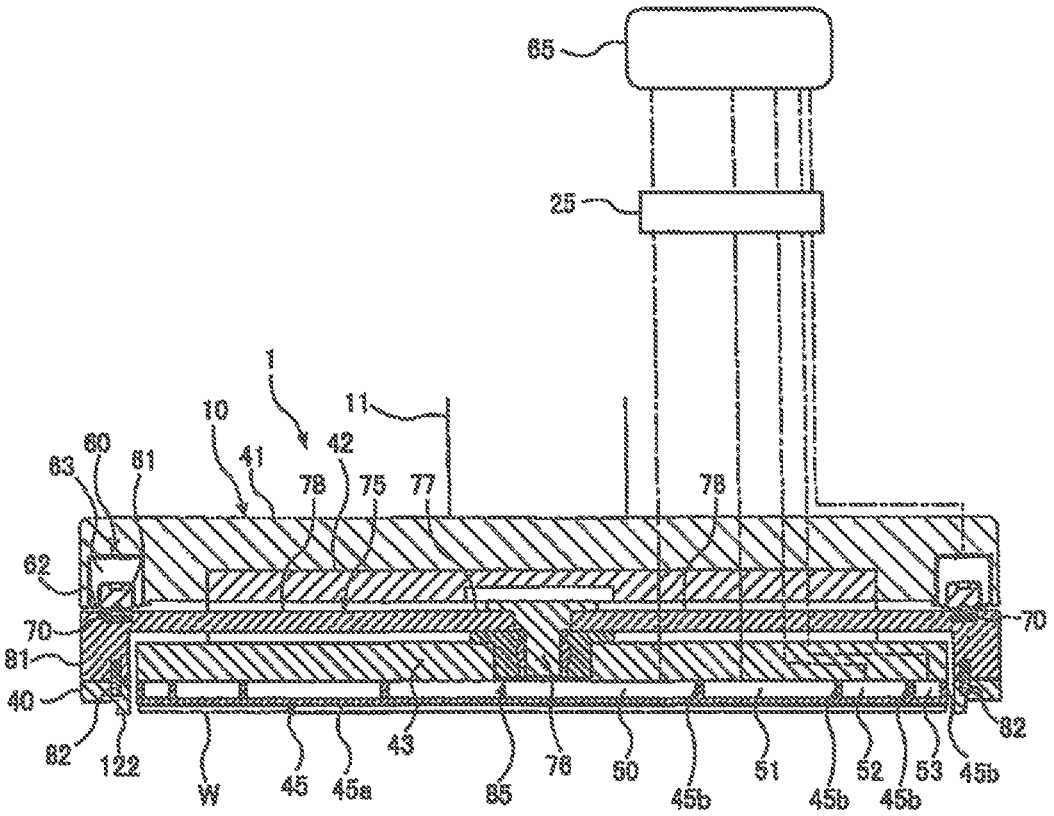
FIG. 3 is a cross-sectional view of a top ring.

The top ring 1, which serves as the substrate holder, will be described in detail below. Ha 3 is a cross-sectional view of the top ring 1. As shown in FIG. 3, the top ring 1 includes a top ring body 10 for holding the wafer W and pressing the wafer W against the polishing surface 2*a*, and a retaining ring 40 disposed so as to surround the wafer W. The top ring body 10 and the retaining ring 40 are rotatable in unison by the rotation of the top ring shaft 11. The retaining ring 40 is configured to be vertically movable relative to the top ring body 10.

The top ring body 10 has a circular flange 41, a spacer 42 mounted to a lower surface of the flange 41, and a carrier 43 mounted to a lower surface of the spacer 42. The flange 41 is coupled to the top ring shaft 11. The carrier 43 is coupled to the flange 41 through the spacer 42, so that the flange 41, the spacer 42, and the carrier 43 rotate and vertically move together. The top ring body 10, which is constructed by the flange 41, the spacer 42, and the carrier 43, is made of resin, such as engineering plastic (e.g., PEEK). The flange 41 may be made of metal, such as SUS, aluminum, or the like.

A flexible membrane 45, which is brought into contact with a back surface of the wafer W, is attached to a lower surface of the carrier 43 of the top ring body 10. This flexible membrane 45 has a lower surface which serves as a substrate holding surface 45*a*. The flexible membrane 45 further has annular partition walls 45*b* which define four pressure chambers: a central chamber 50; a ripple chamber 51; an outer chamber 52; and an edge chamber 53, which are located between the flexible membrane 45 end the top ring body 10. These pressure chambers 50 to 53 are in fluid communication with a pressure regulator 65 via the rotary joint 25, so that pressurized fluid is supplied into these pressure chambers 50 to 53 from the pressure regulator 65. This pressure regulator 65 is configured to be able to regulate pressures in the respective four pressure chambers 50 to 53 independently. Further, the pressure regulator 65 is configured to be able to produce negative pressure in the pressure chambers 50 to 53.

The flexible membrane 45 has a through-hole (not shown) in a position corresponding to the tipple chamber 51 or the outer chamber 52, so that the top ring 1 can hold the substrate on its substrate holding surface 45*a* by producing the negative pressure in the through-hole. The flexible membrane 45 is made of a highly strong and durable rubber material, such as ethylene propylene rubber (EPDM), polyurethane rubber, silicone rubber, or the like. The central chamber 50, the ripple chamber 51, the outer chamber 52, and the edge chamber 53 are further coupled to a ventilation mechanism (not shown), which can establish a fluid communication between the atmosphere and these four pressure chambers 50 to 53.

The retaining ring 40 is disposed so as to surround the carrier 43 of the top ring body 10 and the flexible membrane 45. This retaining ring 40 is a ring-shaped member which is brought into contact with the polishing surface 2*a* of the polishing pad 2. The retaining ring 40 is disposed so as to surround a peripheral edge of the wafer W and retains the wafer W therein so as to prevent the wafer W from being separated from the top ring 1 when the wafer W is being polished.

An upper surface of the retaining ring 40 is secured to a drive ring 81. The drive ring 81 has an upper portion coupled to an annular retaining ring pressing mechanism 60, which is configured to exert a uniform downward load on the upper surface of the retaining ring 40 in its entirety through the drive ring 81 to thereby press a lower surface of the retaining ring 40 against the polishing surface 2*a* of the polishing pad 2.

The retaining ring pressing mechanism 60 includes an annular piston 61 fixed to the upper portion of the drive ring 81, and an annular rolling diaphragm 62 connected to an upper surface of the piston 61. The rolling diaphragm 62 defines a retaining ring pressure chamber 63 therein. This retaining ring pressure chamber 63 is in fluid communication with the pressure regulator 65 through the rotary joint 25.

When the pressure regulator 65 supplies a pressurized fluid (e.g., pressurized air) into the retaining ring pressure chamber 63, the rolling diaphragm 62 pushes down the piston 61, which in turn pushes down the retaining ring 40 in its entirety through the drive ring 81. In this manner, the retaining ring pressing mechanism 60 presses the lower surface of the retaining ring 40 against the polishing surface 2*a* of the polishing pad 2. Further, when the pressure regulator 65 develops the negative pressure in the retaining ring pressure chamber 63, the retaining ring 40 in its entirety is elevated. The retaining ring pressure chamber 63 is further coupled to a ventilation mechanism (not shown), which can establish a fluid communication between the atmosphere and the retaining ring pressure chamber 63.

The drive ring 81 is removably coupled to the retaining ring pressing mechanism 60. More specifically, the piston 61 is made of a magnetic material, such as metal, and a plurality of magnets 70 are disposed in the upper portion of the drive ring 81. These magnets 70 magnetically attract the piston 61, so that the drive ring 81 is secured to the piston 61 via a magnetic force. The magnetic material of the piston 61 may be corrosion resisting magnetic stainless steel. In another embodiment, the drive ring 81 may be made of a magnetic material, and magnets may be disposed in the piston 61.

Figure 4:
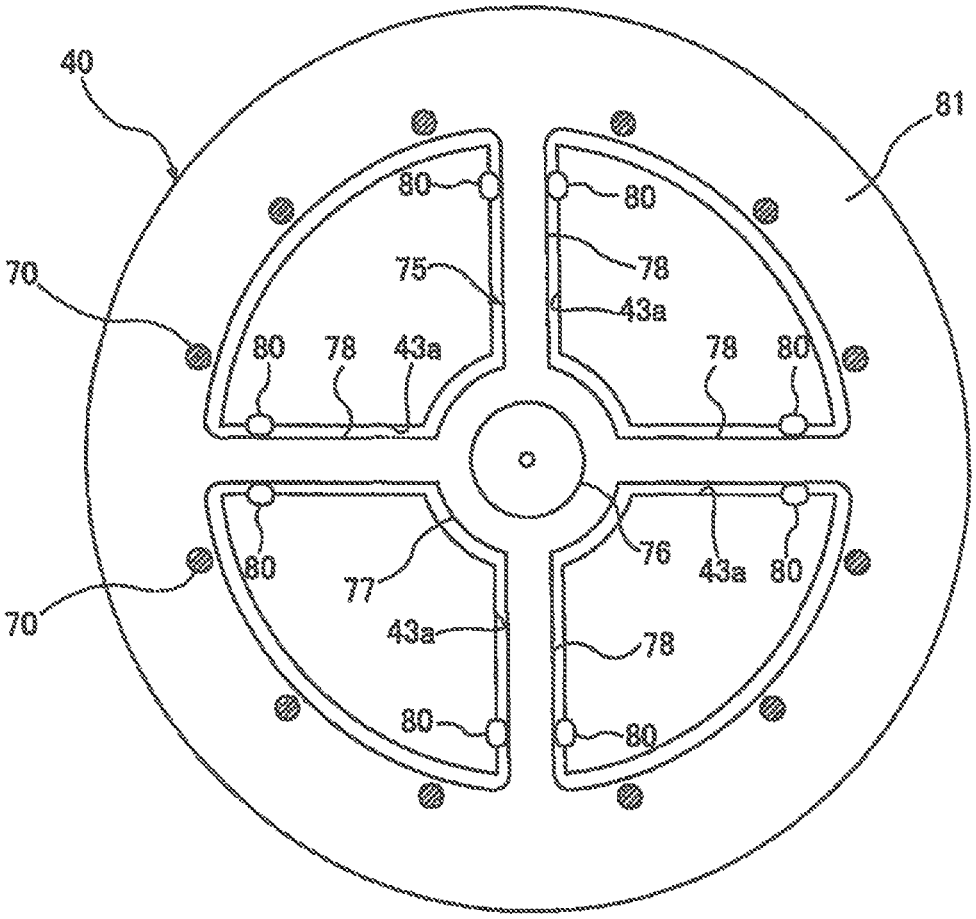
FIG. 4 is a plan view showing a drive ring and a coupling member.

The retaining ring 40 is coupled to a spherical bearing 85 through the drive ring 81 and a coupling member 75. The spherical bearing 85 is disposed radially inwardly of the retaining ring 40. FIG. 4 is a plan view showing the drive ring 81 and the coupling member 75. As shown in FIG. 4, the coupling member 75 includes a vertically extending shaft portion 76 disposed centrally in the top ring body 10, a hub 77 secured to the shaft portion 76, and a plurality of spokes 78 extending radially from the hub 77.

The spokes 78 have one ends fixed to the hub 77, and have the other ends fixed to the drive ring 81. In this embodiment, the hub 77, the spokes 78, and the drive ring 81 are formed integrally. Plural pairs of drive pins 80 and 80 are secured to the carrier 43. The drive pins 80 and 80 of each pair are arranged on both sides of each spoke 78. The rotation of the carrier 43 is transmitted to the drive ring 81 and the retaining ring 40 through the drive pins 80 and 80 to thereby rotate the top ring body 10 and the retaining ring 40 together with each other.

As shown in FIG. 3, the shaft portion 76 extends in the vertical direction in the spherical bearing 85. As shown in FIG. 4, the carrier 43 has a plurality of radial grooves 43*a* in which the spokes 78 are disposed, respectively. Each spoke 78 is movable freely in the vertical direction in each groove 43*a*. The shaft, portion 76 of the coupling member 75 is supported by the spherical bearing 85 such that the shaft portion 76 can move in the vertical direction. The spherical bearing 85 is located at the center of the top ring body 10. The coupling member 75, and the drive ring 81 and the retaining ring 40, which are coupled to the coupling member 75, are thus vertically movable relative to the top ring body 10. Further, the drive ring 81 and the retaining ring 40 are tiltably supported by the spherical bearing 85.

Figure 5:
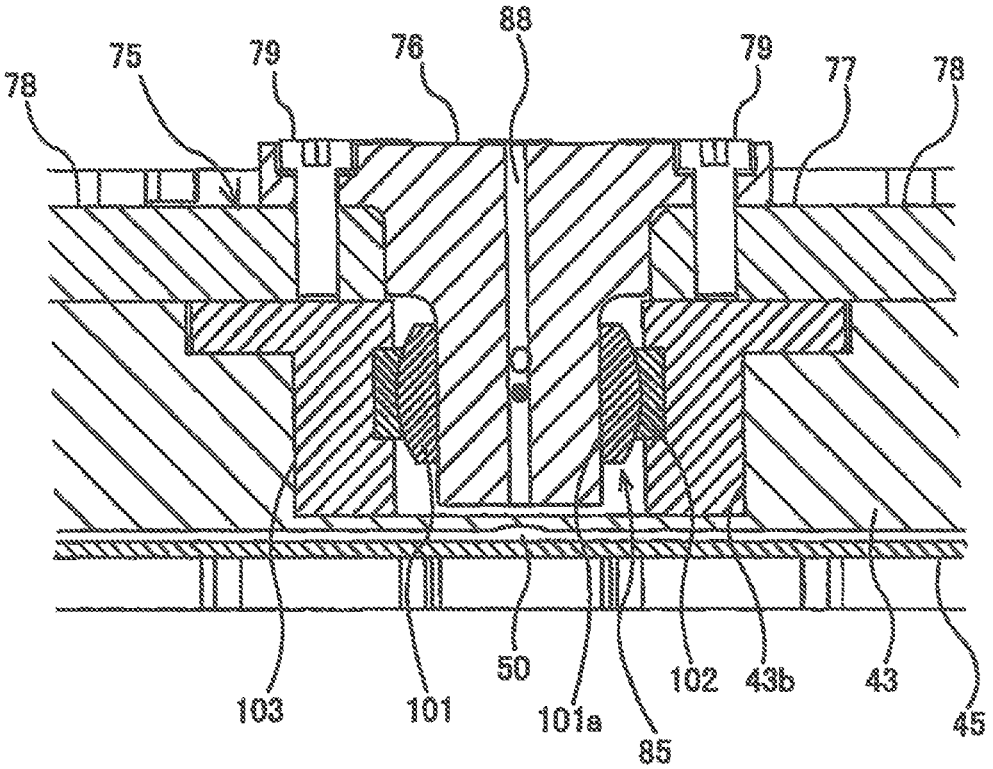
FIG. 5 is a view of a spherical bearing.

FIG. 5 is a view of the spherical bearing 85. As shown in FIG. 5, the shaft portion 76 is secured to the hub 77 by a plurality of screws 79. The shaft portion 76 has a vertically extending through-hole 88 formed therein. This through-hole 88 acts as an air vent hole when the shaft portion 76 moves vertically relative to the spherical bearing 85. Therefore, the retaining ring 40 can move smoothly in the vertical direction relative to the top ring body 10.

A spherical bearing 85 includes an annular inner bearing ring 101, and an annular outer bearing ring 102 which slidably supports an outer circumferential surface of the inner bearing ring 101. The inner bearing ring 101 is coupled to the drive ring 81 and the retaining ring 40 through the coupling member 75. The outer bearing ring 102 is secured to a support member 103, which is secured to the carrier 43. The support member 103 is disposed in a recess 43*b* which is formed in the central portion of the carrier 43.

The outer circumferential surface of the inner bearing ring 101 has a spherical shape whose upper and lower portions are cut off. A central point (fulcrum) ○ of this spherical shape is located at the center of the inner bearing ring 101. The outer bearing ring 102 has an inner circumferential surface which is a concave surface shaped so as to fit the outer circumferential surface of the inner bearing ring 101, so that the outer bearing ring 102 slidably supports the inner bearing ring 101. Therefore, the inner bearing ring 101 is tiltable in all directions through 360° relative to the outer bearing ring 102.

The inner bearing ring 101 has an inner circumferential surface which forms a through-hole 101*a* in which the shaft portion 76 is inserted. The shaft portion 76 is movable relative to the inner bearing ring 101 only in the vertical direction. Therefore, the retaining ring 40, which is coupled to the shaft portion 76, is not allowed to move laterally. That is, the retaining ring 40 is fixed in its lateral position (i.e., its horizontal position) by the spherical bearing 85. The spherical bearing 85 serves as a supporting mechanism capable of supporting or receiving the lateral force (i.e., the force in the radially outward direction of the wafer) applied from the wafer to the retaining ring 40 due to the friction between the wafer and the polishing pad 2 and capable of restricting the lateral movement of the retaining ring 40 (i.e., capable of fixing the horizontal position of the retaining ring 40).

Figure 6A:
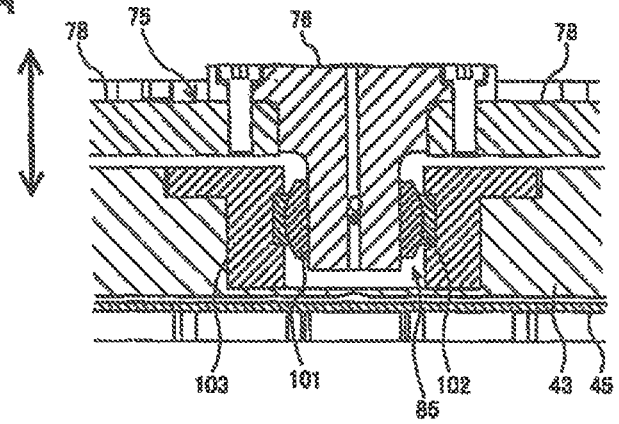
FIG. 6A is a view showing a manner in which the coupling member is vertically moved relative to the spherical bearing.
Figure 6B:
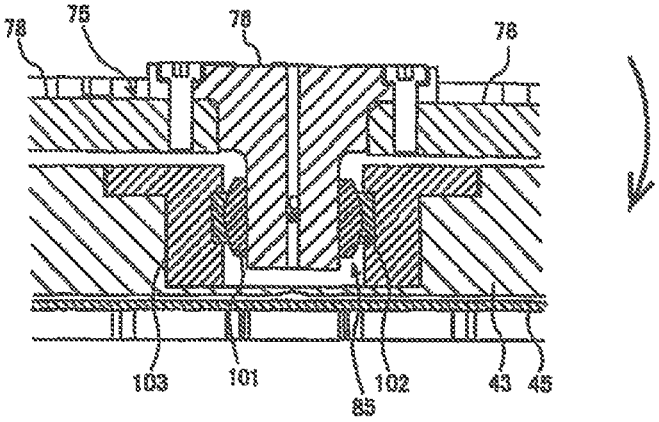
FIG. 6B and FIG. 6C are views each showing a manner in which the coupling member tilts in unison with an inner bearing ring.
Figure 6C:
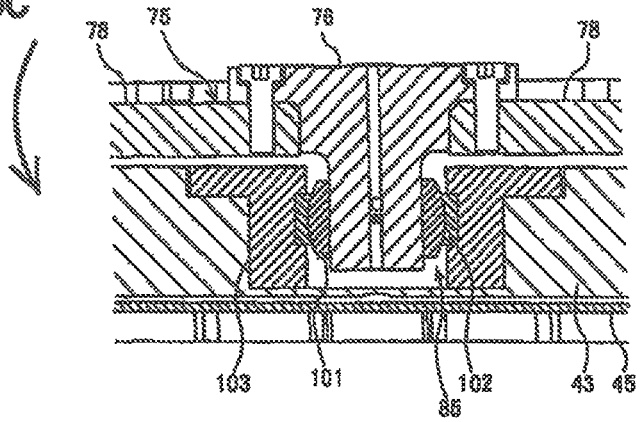

FIG. 6A shows the manner in which the coupling member 75 is vertically moved relative to the spherical bearing 85. FIGS. 6B and 6C show the manner in which the coupling member 75 tilts together with the inner bearing ring 101. The coupling member 75 and the retaining ring 40 coupled thereto are tiltable around the fulcrum ○ together with the inner bearing ring 101 and are vertically movable relative to the inner bearing ring 101.

Figure 7:
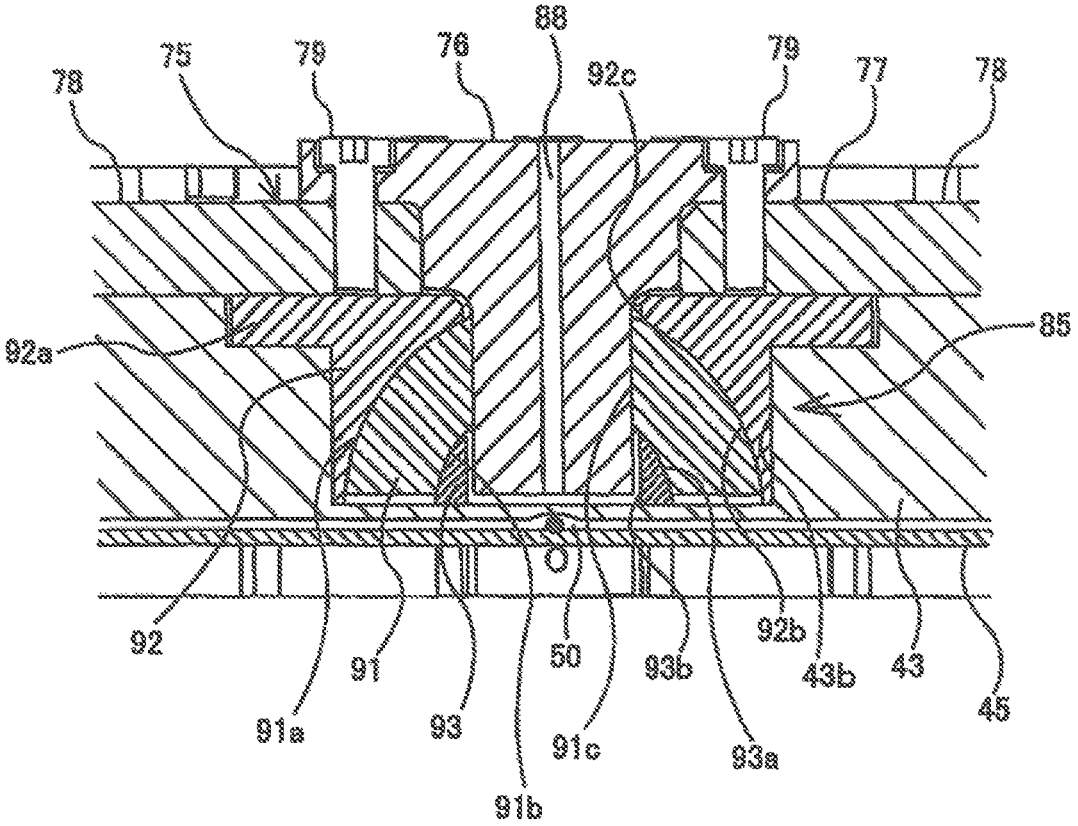
FIG. 7 is an enlarged cross-sectional view of another example of the spherical bearing.

FIG. 7 is an enlarged cross-sectional view of another example of the spherical bearing 85. As shown in FIG. 7, the spherical bearing 85 includes an intermediate bearing ring 91 coupled to the retaining ring 40 through the coupling member 75, an outer bearing ring 92 slidably supporting the intermediate bearing ring 91 from above, and an inner bearing ring 93 slidably supporting the intermediate bearing ring 91 from below. The intermediate bearing ring 91 is in the form of a partial spherical shell smaller than an upper half of a spherical shell. The intermediate bearing ring 91 is sandwiched between the outer bearing ring 92 and the inner bearing ring 93.

The outer bearing ring 92 is disposed in the recess 43*b*. The outer bearing ring 92 has a flange portion 92*a* on its outer circumferential surface. The flange portion 92*a* is secured to a step of the recess 43*b* by bolts (not shown), thereby securing the outer bearing ring 92 to the carrier 43 and applying pressure to the intermediate bearing ring 91 and the inner bearing ring 93. The inner bearing ring 93 is disposed on a bottom surface of the recess 43*b*. This inner bearing ring 93 supports the intermediate bearing ring 91 upwardly so as to form a gap between a lower surface of the intermediate bearing ring 91 and the bottom surface of the recess 43*b*.

The outer bearing ring 92 has an inner surface 92*b*, the intermediate bearing ring 91 has an outer surface 91*a* and an inner surface 91*b*, and the inner bearing ring 93 has an outer surface 93*a*. Each of these surfaces 92*b*, 91*a*, 91*b*, and 93*a* is an approximately hemispheric surface whose center is represented by a fulcrum ○. The outer surface 91*a* of the intermediate bearing ring 91 slidably contacts the inner surface 92*b* of the outer bearing ring 92. The inner surface 91*b* of the intermediate bearing ring 91 slidably contacts the outer surface 93*a* of the inner bearing ring 93. The inner surface 92*b* (sliding contact surface) of the outer bearing ring 92, the outer surface 91*a* and the inner surface 91*b* (sliding contact surfaces) of the intermediate bearing ring 91, and the outer surface 93*a* (sliding contact surface) of the inner bearing ring 93 have a partial spherical shape smaller than an upper half of a spherical surface. With these configurations, the intermediate bearing ring 91 is tiltable in all directions through 360° relative to the outer bearing ring 92 and the inner bearing ring 93. The fulcrum ○, which is the center of the tilting movement of the intermediate bearing ring 91, is located below the spherical bearing 85.

The outer bearing ring 92, the intermediate bearing ring 91, and the inner bearing ring 93 have respective through-holes 92*c*, 91*c*, and 93*b* funned therein in which the shaft portion 76 is inserted. There is a gap between the through-hole 92*c* of the outer bearing ring 92 and the shaft portion 76. Similarly, there is a gap between the through-hole 93*b* of the inner bearing ring 93 and the shaft portion 76. The through-hole 91*c* of the intermediate bearing ring 91 has a diameter smaller than those of the through-holes 92*o* and 93*b* of the outer bearing ring 92 and the inner bearing ring 93 such that the shaft portion 76 is movable relative to the intermediate bearing ring 91 only in the vertical direction. Therefore, the retaining ring 40, which is coupled to the shaft portion 76, is substantially not allowed to move laterally. That is, the retaining ring 40 is fixed in its lateral position (i.e., its horizontal position) by the spherical bearing 85.

Figure 8A:
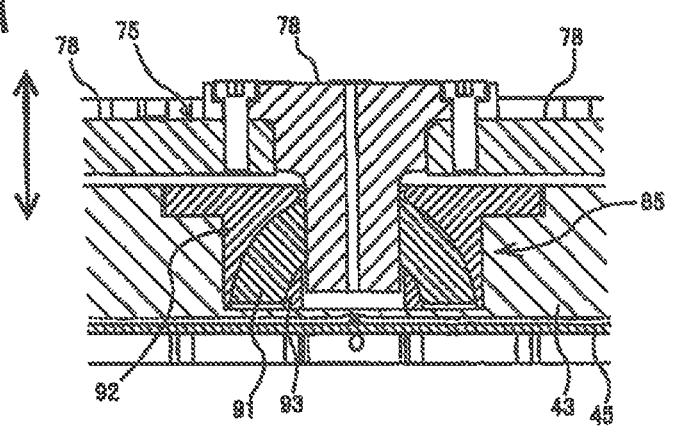
FIG. 8A a view showing a manner in which the coupling member is vertically moved relative to the spherical bearing.
Figure 8B:
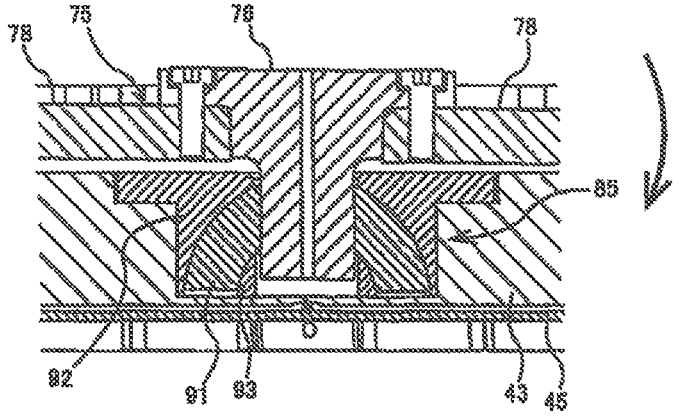
FIG. 8B and FIG. 8C are views each showing a manner in which the coupling member tilts in unison with an intermediate bearing ring.
Figure 8C:
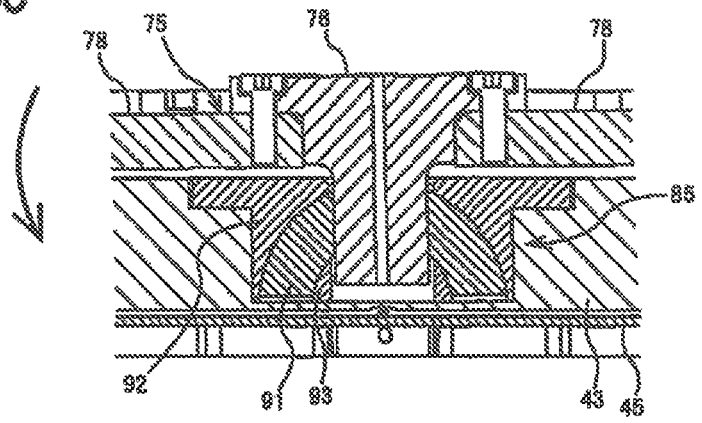

FIG. 8A shows the manner in which the coupling member 75 is vertically moved relative to the spherical bearing 85, and FIGS. 8B and 8C show the manner in which the coupling member 75 tilts together with the intermediate bearing ring 91. As shown in FIGS. 8A through 8C, the retaining ring 40, which is coupled to the coupling member 75, is bitable around the fulcrum ○ together with the intermediate bearing ring 91 and is vertically movable relative to the intermediate bearing ring 91. The spherical bearing 85 shown in FIG. 7 is the same as the spherical bearing 85 shown in FIG. 5 in that the fulcrum ○, which is the center of the tilting movement, is on a central axis of the retaining ring 40, but differs in that the fulcrum ○ shown in FIG. 7 is located at a position lower than the fulcrum ○ shown in FIG. 5. The spherical bearing 85 shown in FIG. 7 can provide the fulcrum ○ at the same height of the surface of the polishing pad 2 or lower than the surface of the polishing pad 2.

Figure 9:
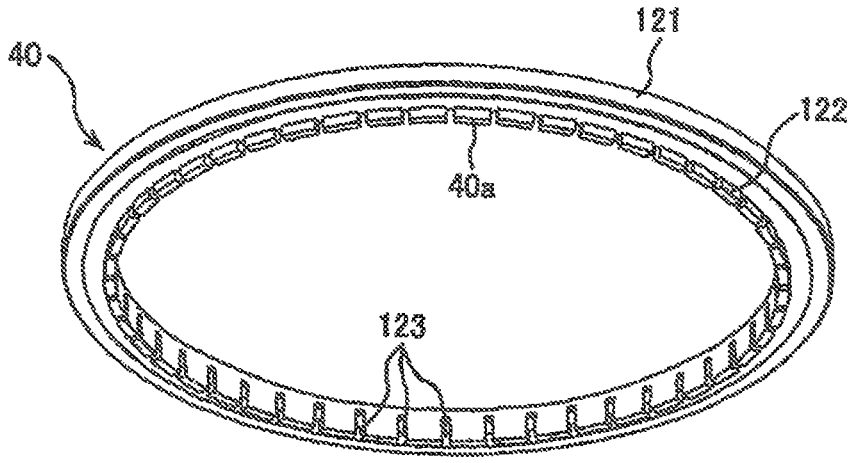
FIG. 9 is a perspective view of the retaining ring.
Figure 10:
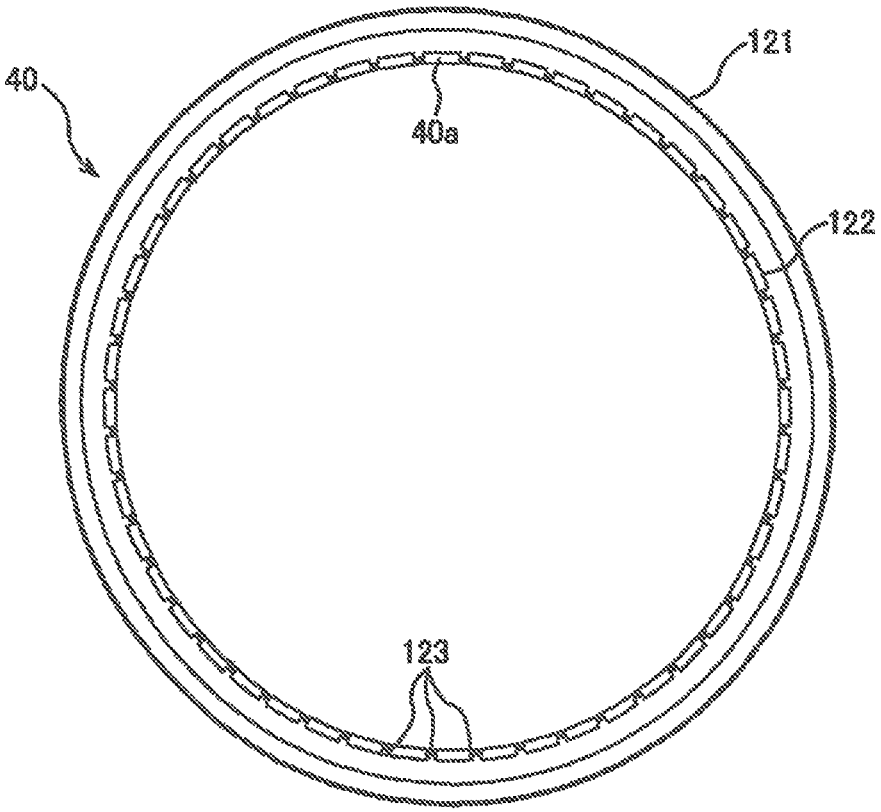
FIG. 10 is a bottom view of the retaining ring.
Figure 11:
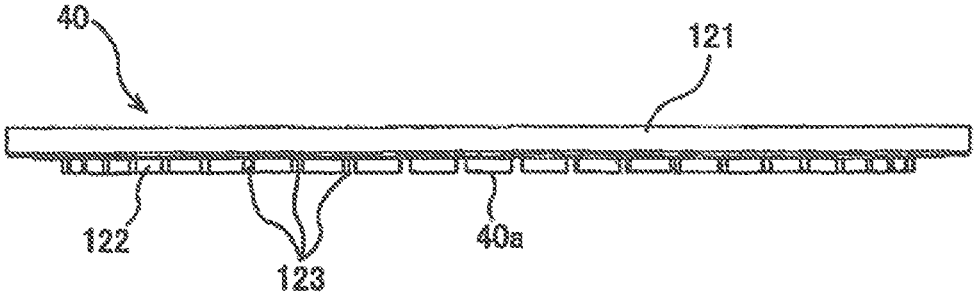
FIG. 11 is a side view of the retaining ring.
Figure 12A:
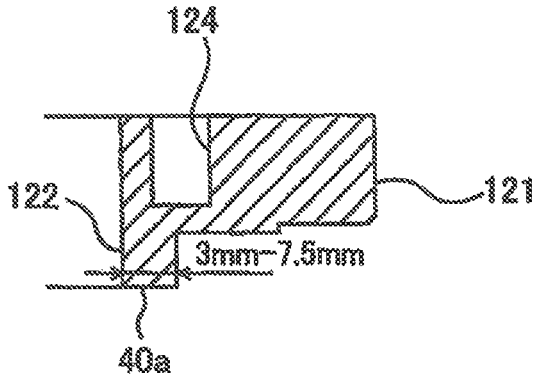
FIG. 12A is a vertical cross-sectional view showing a part of the retaining ring.
Figure 12B:
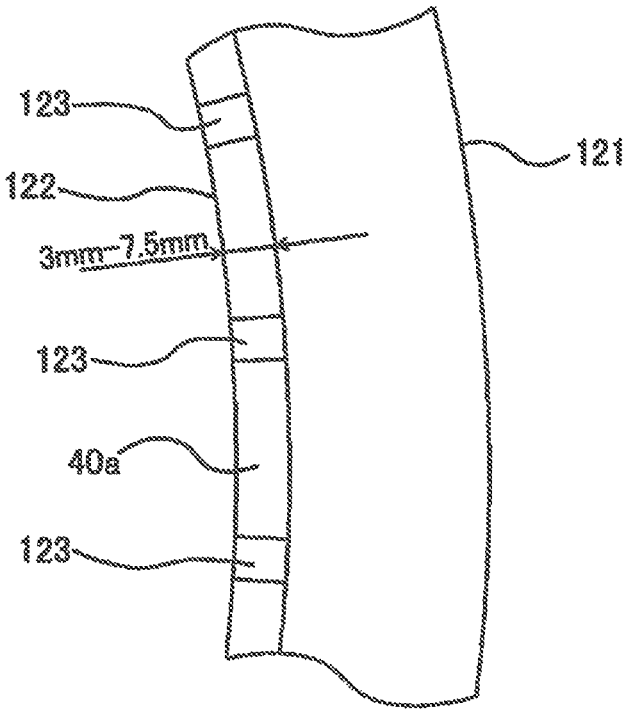
FIG. 12B is a bottom view showing a part of the retaining ring.

FIG. 9 is a perspective view of the retaining ring 40, FIG. 10 is a bottom view of the retaining ring 40, and FIG. 11 is a side view of the retaining ring 40. FIG. 12A is a vertical cross-sectional view showing a part of the retaining ring 40, and FIG. 12B is a bottom view showing a part of the retaining ring 40. A diameter of an inner circumferential surface of the retaining ring 40, i.e., an inside diameter of the retaining ring 40, is slightly larger than a diameter of the wafer. More specifically, the diameter of the inner circumferential surface of the retaining ring 40 is larger than the diameter of the wafer by 0.5 mm to 3 mm, preferably 1 mm to 2 mm.

The retaining ring 40 includes an annulus 121 and a pad pressing structure 122. The pad pressing structure 122 has an annular shape and extends downwardly from an inner circumferential end of the annulus 121. The annulus 121 and the pad pressing structure 122 are integrally formed from the same material. The pad pressing structure 122 is disposed so as to surround the wafer held on the flexible membrane 45 (see FIG. 3) of the top ring body 10. A width of the pad pressing structure 122 (i.e., a width of the pad pressing structure 122 in the radial direction of the retaining ring 40) is smaller than a width of the annulus 121. Specifically, the width of the pad pressing structure 122 is not less than 3 mm and not more than 7.5 mm, more preferably not less than 3 mm and not more than 5 mm. A height of the pad pressing structure 122 may be the same as or greater than the width of the pad pressing structure 122.

The pad pressing structure 122 has a lower surface that serves as a pad contact surface 40*a* to be brought into contact with the polishing pad 2. Specifically, during polishing of the wafer, the pad contact surface 40*a* of the pad pressing structure 122 is pressed against the polishing pad 2. A plurality of radial grooves 123 extending in the radial direction of the retaining ring 40 are formed in the pad contact surface 40*a*. These radial grooves 123 are configured to allow the polishing liquid, supplied to the polishing pad 2, to flow from the inside to the outside of the retaining ring 40 and from the outside to the inside of the retaining ring 40. For example, each radial groove 123 has a width of 4 mm.

The retaining ring 40 has a plurality of holes 124 arranged along its circumferential direction (only one of the holes 124 is shown in FIG. 12A). More specifically, these holes 124 are formed in an upper surface of the annulus 121 of the retaining ring 40. As shown in FIG. 3, a plurality of stainless-steel reinforcement pins 82 are fixed to a lower portion of the drive ring 81, and these reinforcement pins 82 are inserted respectively into the holes 124 of the retaining ring 40. A strength of the retaining ring 40 is enhanced by these reinforcement pins 82.

Figure 13A:
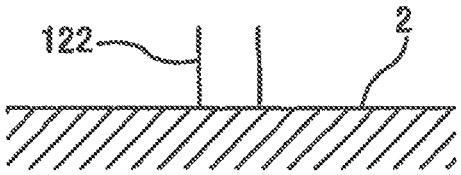
FIG. 13A, FIG. 13B, FIG. 13C and FIG. 13D are views each showing a manner in which a pad pressing structure wears due to the sliding contact with the polishing pad.
Figure 13B:
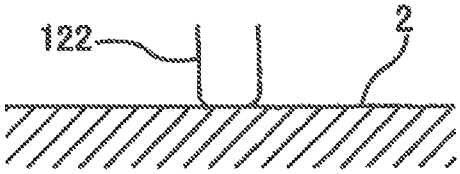
Figure 13C:
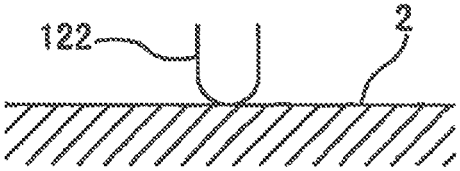
Figure 13D:
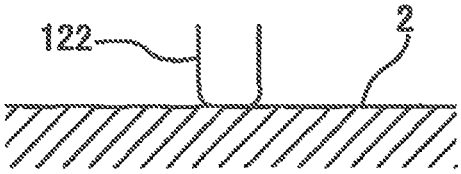

A conventional retaining ring has a width of about 15 mm. In contrast, the retaining ring 40 according to an embodiment has a width in the range of 3 mm to 7.5 mm. Since the width of the pad pressing structure 122 is small, the pad pressing structure 122 has a self-restoring function of its shape. The self-restoring function will now be described in detail with reference to FIGS. 13A to 13D), each of which shows a manner in which the pad pressing structure 122 wears due to the sliding contact with the polishing pad 2. As shown in FIG. 13A, the pad pressing structure 122 in an initial state has a rectangular vertical section. As the pad pressing structure 122 is placed in sliding contact with the polishing pad 2, the pad pressing structure 122 wears. As a result, as shown in FIG. 13B, an inner edge and an outer edge of the pad pressing structure 122 become rounded, thus reducing an area of the pad contact surface 40*a*. As the wear of the pad pressing structure 122 further progresses, the area of the pad contact surface 40*a* is further reduced, as shown in FIG. 13C.

Under the condition that the downward load applied to the retaining ring 40 is constant, as the area of the pad contact surface 40*a* is reduced, the pressure of the pad contact surface 40*a* is increased. As a result, as shown in FIG. 131), the pad pressing structure 112 wears in a manner as to increase the area of the pad contact surface 40*a*. While such small changes in the pressure and the area of the pad contact surface 40*a* occur repeatedly, the shape of the pad pressing structure 122 is kept approximately constant. Therefore, the retaining ring 40 having the narrow pad pressing structure 122 can stabilize the polishing rate at the edge portion of the wafer.

Figure 14:
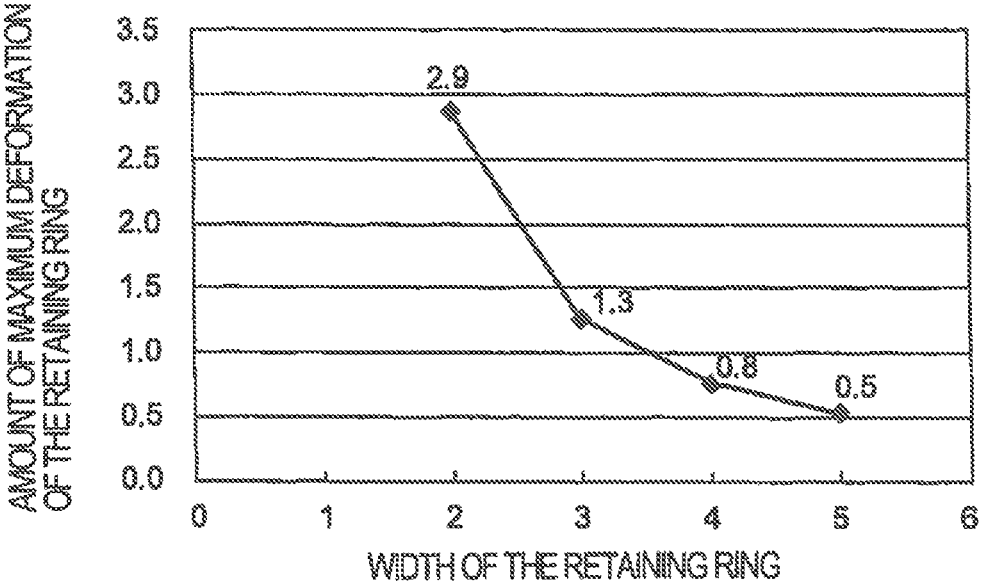
FIG. 14 is a graph showing results of a structural analysis that has studied a relationship between the width of the pad pressing structure and an amount of deformation of the pad pressing structure.

A lower limit value of the width of the pad pressing structure 122 is 3 mm, which is determined based on a mechanical strength of the pad pressing structure 122. FIG. 14 is a graph showing results a structural analysis that has studied a relationship between the width of the pad pressing structure 122 and an amount of deformation of the pad pressing structure 122. In FIG. 14, horizontal axis represents the width of the pad pressing structure 122 and vertical axis represents amount of maximum deformation (calculated value) in a lateral direction of the pad pressing structure 122. The structural analysis was conducted on five retaining rings of 1 mm, 2 mm, 3 mm, 4 mm, and 5 mm in width. Specifically, the amount of lateral deformation of the pad pressing structure 122 was calculated under a condition that a force is applied from the wafer to a side surface of the retaining ring when polishing the wafer. A material of the retaining rings used in this structural analysis was polyphenylene sulfide.

In the case of the pad pressing structure 122 having the width of 1 mm, the amount of deformation of the pad pressing structure 122 was too large to calculate. In the case of the pad pressing structure 122 having the width of 2 mm, the amount of deformation of the pad pressing structure 122 was large. In the case of the pad pressing structure 122 having the width of not less than 3 mm, the amount of deformation of the pad pressing structure 122 was small. In particular, it can be seen from the graph that the width of less than 3 mm results in a large amount of deformation of the pad pressing structure 122. From these structural analysis results, the lower limit value of the width of the pad pressing structure 122 was determined to be 3 mm.

Figure 15:
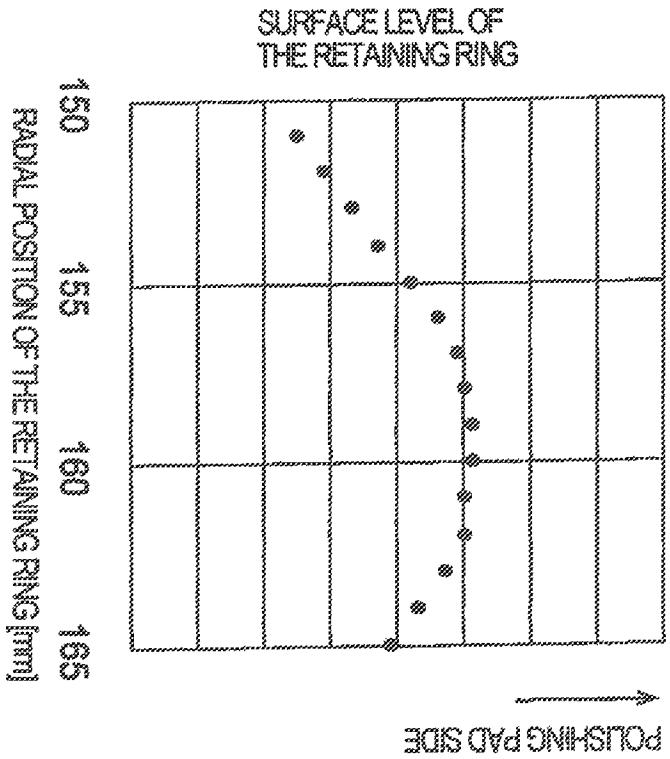
FIG. 15 is a graph showing a surface shape of a conventional wide retaining ring after a plurality of wafers have been polished.

FIG. 15 is a graph showing a surface shape of a conventional retaining ring of wide type after a plurality of wafers have been polished. In FIG. 15, vertical axis represents a level (a position in the vertical direction) of the pad contact surface of the retaining ring, and indicates that a distance from the polishing pad to the pad contact surface. Specifically, a lower position on the vertical axis indicates a longer distance from the polishing pad to the pad contact surface. Horizontal axis in FIG. 15 represents position of measurement point of the level of the pad contact surface. The level measurement points are arrayed along the radial direction of the retaining ring.

As can be seen from FIG. 15, in the conventional retaining ring, the pad contact surface wears greatly in a region of 7 mm in width extending outwardly from the inner circumferential surface (i.e., wafer holding surface) of the retaining ring. If such an inner region of the pad contact surface wears greatly, the retaining ring cannot press the polishing pad along the edge portion of the wafer. As a result, the polishing rate of the edge portion of the wafer is increased.

Figure 16:
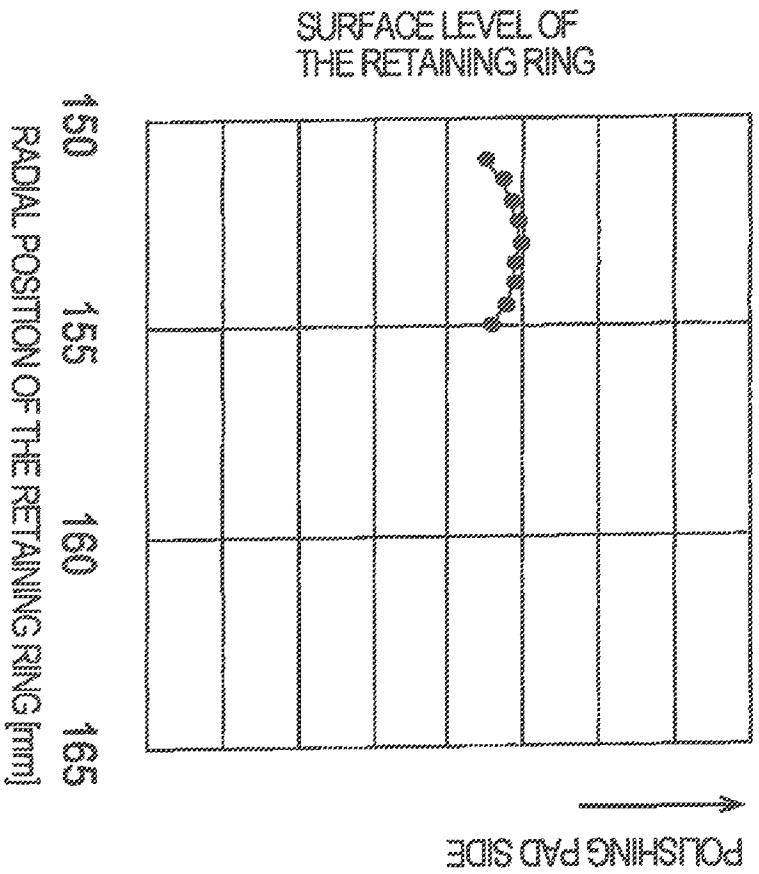
FIG. 16 is a graph showing a surface shape of the retaining ring, having the pad pressing structure with the width of 5 mm, after a plurality of wafers have been polished.

FIG. 16 is a graph showing a surface shape of the retaining ring according to the embodiment, having the pad pressing structure 122 with the width of 5 mm, after a plurality of wafers have been polished. It can be seen from FIG. 16 that, even if a plurality of wafers have been polished, the inner region of the pad contact surface 40*a* of the retaining ring 40 does not wear greatly as compared with the conventional retaining ring shown in FIG. 15. More specifically, the inner region of 3 mm in width extending from the inner circumferential surface (i.e., wafer holding surface) of the pad pressing structure 122 does not wear greatly, compared with other region. Therefore, the taming ring 40 having the pad pressing structure 122 of 5 mm in width can press the region of 3 mm in width extending from the inner circumferential surface (i.e., wafer holding surface) of the pad pressing structure 122. As can be seen from FIG. 16, even in the case where a plurality of the wafers have been polished, the shape of the pad contact surface 40*a* does not change much. Therefore, the retaining ring 40 can press the polishing pad 2 along the edge portion of the wafer well. As a result, the polishing rate of the edge portion of the wafer does not increase much, and a good profile can be realized in the edge portion of the wafer. That is, even in the case of continuously polishing the plurality of the wafers, a good profile can stably be realized in the edge portion of the wafer.

Figure 17:
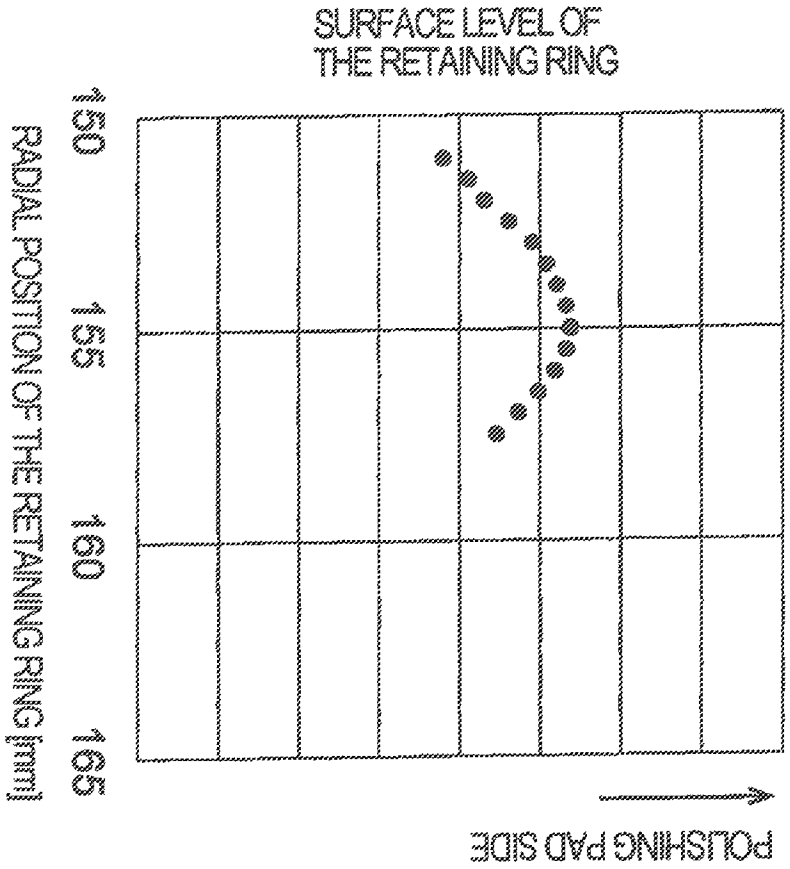
FIG. 17 is a graph showing a surface shape of the retaining ring, having the pad pressing structure with the width of 7.5 mm, after a plurality of wafers have been polished.

FIG. 17 is a graph showing a surface shape of the retaining ring 40 according to the embodiment, having the pad pressing structure 122 with a width of 7.5 mm, after a plurality of wafers have been polished. As can be seen from FIG. 17, the inner region of 5 mm in width extending from the inner circumferential surface (i.e., wafer holding surface) of the pad pressing structure 122 does not wear greatly, compared with other region. That is, the retaining ring 40 according to the embodiment having the pad pressing structure 122 of 7.5 mm in width can press the region of 5 mm in width extending from the inner circumferential surface (wafer holding surface) of the pad pressing structure 122. As a result, the polishing rate of the edge portion of the wafer does not increase much, and a good profile can be realized in the edge portion of the wafer. That is, even in the case of continuously polishing the plurality of the wafers, a good profile can stably be realized in the edge portion of the wafer.

Figure 18:
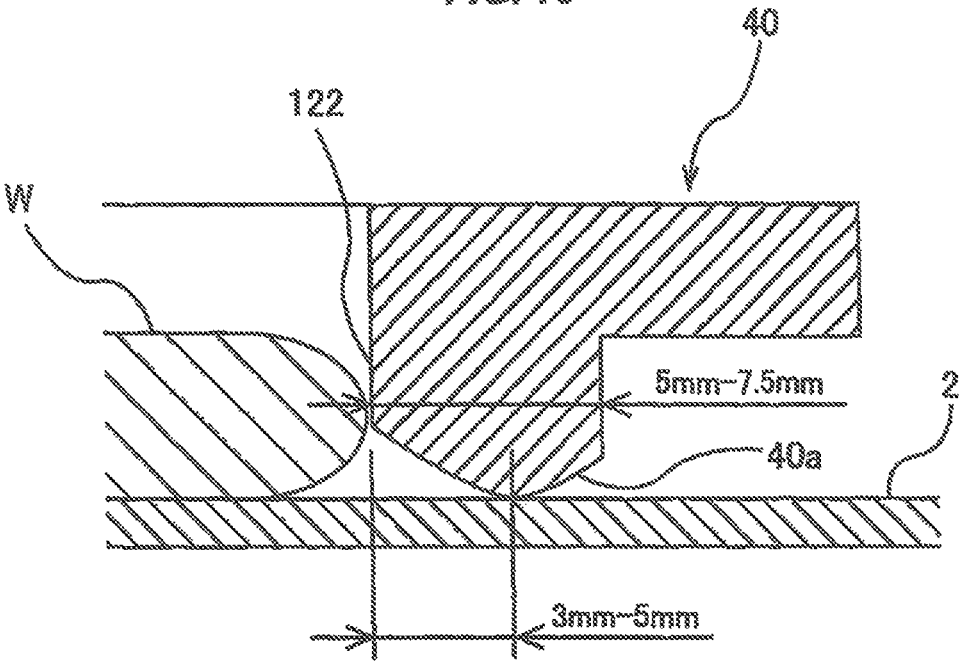
FIG. 18 is a cross-sectional view showing another embodiment of the retaining ring having the pad pressing structure.
Figure 19:
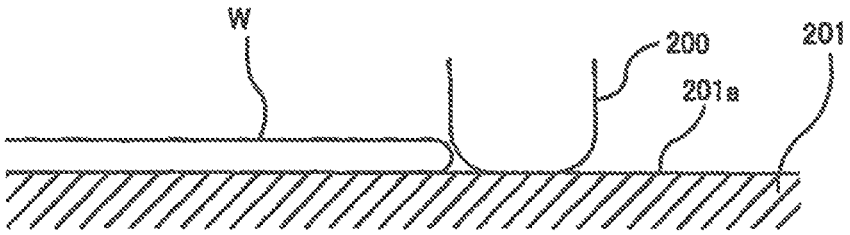
FIG. 19 is a schematic view showing the retaining ring when polishing the wafer.

FIG. 18 is a cross-sectional view showing another embodiment of the retaining ring 40 having the pad pressing structure 122. The pad pressing structure 122 of this embodiment has a width of not less than 5 mm and not more than 7.5 mm. The pad pressing surface 40*a* to be brought into contact with the polishing pad 2 has a cross section projecting downwardly. A lowest point of the pad pressing surface 40*a* is located within a range of 3 mm to 5 mm from the inner circumferential surface of the pad pressing structure 122. In other words, a ratio of the distance between the inner circumferential surface of the pad pressing structure 122 and the lowest point of the pad contact surface 40*a* to the width of the pad pressing structure 122 is in a range of ⅗ to ⅔. As shown in FIGS. 16 and 17, the retaining ring 40 having such surface shape can press a region close to the inner circumferential surface (i.e., wafer holding surface) of the pad pressing structure 122. As a result, the polishing rate of the edge portion of the wafer does not increase much, and a good profile can be realized in the edge portion of the wafer.

The substrate holder according to the above-discussed embodiments can be preferably used for a semiconductor device manufacturing process, such as a shallow trench isolation (STI) process.

The polishing pad 2 has a layered structure including an upper layer made of foamed polyurethane and a lower layer made of a nonwoven fabric. The upper layer has a highly-uniform structure containing fine foam therein and has a modulus of elasticity of about 50 MPa to 100 MPa when the polishing pad 2 is pressed at 4000 hPa to 12000 hPa. The lower layer is an open-cell foam having a modulus of elasticity of about 1.5 MPa to 2.5 MPa when the polishing pad 2 is pressed at 2500 hPa to 4500 hPa. When the taming ring 40 presses the polishing pad 2, the retaining ring 40 sinks down into the polishing pad 2. As a result, a surface pressure at the edge portion of the retaining ring 40 is increased, thereby promoting the wear of this edge portion. Therefore, the retaining ring 40 having the pad pressing structure 122 with the width of not less than 3 mm and not more than 7.5 mm is effective in the case where the polishing pad 2, having the above-described material characteristics, is used.

Polishing conditions of the wafer include a height of the fulcrum of the retaining ring 40 from the surface of the polishing pad 2. In an embodiment, the height of the fulcrum of the retaining ring 40 is in the range of −10 mm to +50 mm. A change in the height of the fulcrum causes a change in an attitude of the retaining ring 40, thus affecting the worn shape of the edge portion of the retaining ring 40. In this case also, the retaining ring 40 having the pad pressing structure 122 with the width of not less than 3 mm and not more than 7.5 mm is effective. When the wafer is transferred between the top ring 1 and a non-illustrated wafer transfer mechanism (or a substrate transfer mechanism), the outer circumferential surface of the retaining ring 40 serves as a guide surface for guiding the wafer transfer mechanism.

In a part of the shallow trench isolation (STI) process, the retaining ring 40 having the pad pressing structure 122 with the width of not less than 3 mm and not more than 7.5 mm is effective because an area of the pad contact surface of the retaining ring 40 does not change greatly.

Although certain embodiments have been described in detail, it should be understood that various changes and modifications may be made without departing from the scope of the technical concept of the present invention.

What is claimed is:

1. A substrate holder for pressing a substrate against a polishing pad, comprising:

a top ring body configured to hold the substrate; and a single retaining ring having an outer circumferential surface which provides a lowest part of an outermost exposed surface of the substrate holder, the single retaining ring including a pad pressing structure in an annular shape which is to be brought into contact with the polishing pad, the pad pressing structure having an inner circumferential surface which provides a substrate holding surface, and the pad pressing structure having a width in a range of 3 mm to 7.5 mm.

2. The substrate holder according to claim 1, wherein the pad pressing structure has a width in a range of 3 mm to 5 mm.

3. The substrate holder according to claim 1, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a lowest point of the pad contact surface is located within a range of 3 mm to 5 mm from the inner circumferential surface of the pad pressing structure.

4. The substrate holder according to claim 1, wherein the pad pressing structure has a height which is not less than the width.

5. The substrate holder according to claim 1, further comprising:

a drive ring; and reinforcement pins fixed to the drive ring and inserted into holes formed in the retaining ring.

6. A substrate holder for pressing a substrate against a polishing pad, comprising:

a top ring body configured to hold the substrate; and a single retaining ring having an outer circumferential surface which provides a lowest part of an outermost exposed surface of the substrate holder, the single retaining ring including a pad pressing structure in an annular shape which is to be brought into contact with the polishing pad, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a ratio of a distance between an inner circumferential surface of the pad pressing structure and a lowest point of the pad contact surface to the width of the pad pressing structure is in a range of ⅗ to ⅔.

7. The substrate holder according to claim 1, wherein a plurality of radial grooves extending in a radial direction of the retaining ring are formed in a lower surface of the pad pressing structure.

8. The substrate holder according to claim 6, further comprising:

a drive ring; and reinforcement pins fixed to the drive ring and inserted into holes formed in the single retaining ring.

9. A polishing apparatus comprising:

a polishing table for supporting a polishing pad;

a substrate holder configured to hold a substrate and to press the substrate against the polishing pad; and a polishing liquid supply nozzle configured to supply a polishing liquid onto the polishing pad, the substrate holder including a top ring body configured to hold the substrate, and a single retaining ring having an outer circumferential surface which provides a lowest part of an outermost exposed surface of the substrate holder, the single retaining ring including a pad pressing structure in an annular shape which is to be brought into contact with the polishing pad, the pad pressing structure having an inner circumferential surface which provides a substrate holding surface, and the pad pressing structure having a width in a range of 3 mm to 7.5 mm.

10. The polishing apparatus according to claim 9, wherein the pad pressing structure has a width in a range of 3 mm to 5 mm.

11. The polishing apparatus according to claim 9, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a lowest point of the pad contact surface is located within a range of 3 mm to 5 mm from the inner circumferential surface of the pad pressing structure.

12. The polishing apparatus according to claim 9, wherein the pad pressing structure has a height which is not less than the width.

13. The polishing apparatus according to claim 9, wherein the substrate holder further includes:

a drive ring; and reinforcement pins fixed to the drive ring and inserted into holes formed in the single retaining ring.

14. A polishing apparatus comprising:

a polishing table for supporting a polishing pad;

a substrate holder configured to hold a substrate and to press the substrate against the polishing pad; and a polishing liquid supply nozzle configured to supply a polishing liquid onto the polishing pad, the substrate holder including a top ring body configured to hold the substrate, and a single retaining ring having an outer circumferential surface which provides a lowest part of an outermost exposed surface of the substrate holder, the single retaining ring including a pad pressing structure in an annular shape which is to be brought into contact with the polishing pad, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a ratio of a distance between an inner circumferential surface of the pad pressing structure and a lowest point of the pad contact surface to the width of the pad pressing structure is in a range of ⅗ to ⅔.

15. The polishing apparatus according to claim 9, wherein a plurality of radial grooves extending in a radial direction of the retaining ring are formed in a lower surface of the pad pressing structure.

16. The polishing apparatus according to claim 14, wherein the substrate holder further includes:

a drive ring; and reinforcement pins fixed to the drive ring and inserted into holes formed in the single retaining ring.

17. A polishing method comprising:

rotating a polishing table and a polishing pad;

supplying a polishing liquid onto the polishing pad; and pressing a substrate against the polishing pad while only a pad pressing structure is surrounding the substrate and pressing the polishing pad, the pad pressing structure having an inner circumferential surface which provides a substrate holding surface, the pad pressing structure being in an annular shape having a width in a range of 3 mm to 7.5 mm.

18. The polishing method according to claim 17, wherein the pad pressing structure has a width in a range of 3 mm to 5 mm.

19. The polishing method according to claim 17, wherein the pad pressing structure has a height which is not less than the width.

20. A retaining ring for use in a substrate holder for pressing a substrate against a polishing pad, comprising:

a pad pressing structure in an annular shape which is to be brought into contact with the polishing pad, the pad pressing structure having an inner circumferential surface which provides a substrate holding surface, the pad pressing structure having a width in a range of 3 mm to 7.5 mm, the retaining ring having holes for receiving reinforcement pins therein.

21. The retaining ring according to claim 20, wherein the pad pressing structure has a width in a range of 3 mm to 5 mm.

22. The retaining ring according to claim 20, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a lowest point of the pad contact surface is located within a range of 3 mm to 5 mm from the inner circumferential surface of the pad pressing structure.

23. The retaining ring according to claim 20, wherein a plurality of radial grooves extending in a radial direction of the retaining ring are formed in a lower surface of the pad pressing structure.

24. The retaining ring according to claim 20, wherein the pad pressing structure has a height which is not less than the width.

25. The polishing apparatus according to claim 20, wherein the pad pressing structure has a height equal to the width.

26. A retaining ring for use in a substrate holder for pressing a substrate against a polishing pad, comprising:

a pad pressing structure in an annular shape which is to be brought into contact with the polishing pad, wherein the retaining ring has holes for receiving reinforcement pins therein, wherein the pad pressing structure has a width in a range of 5 mm to 7.5 mm, wherein the pad pressing structure has a pad contact surface to be brought into contact with the polishing pad, wherein the pad contact surface has a cross section projecting downwardly, and wherein a ratio of a distance between an inner circumferential surface of the pad pressing structure and a lowest point of the pad contact surface to the width of the pad pressing structure is in a range of ⅗ to ⅔.

27. The polishing apparatus according to claim 26, wherein the pad pressing structure has a height equal to the width.

* * * * *